US005546772A

United States Patent [19]

Merlin et al.

[11] Patent Number: 5,546,772

[45] Date of Patent: Aug. 20, 1996

[54] TUB DOOR SYSTEM FOR A TOP LOADING HORIZONTAL AXIS AUTOMATIC WASHER

[75] Inventors: Jean-Paul D. Merlin, Lincoln Township, Berrien County; Brenner M. Sharp, St. Joseph; Eric K. Farrington, Lincoln Township, Berrien County; Vonda K. Johnston, St. Joseph, all of Mich.

[73] Assignee: Whirlpool Corporation, Benton Harbor, Mich.

[21] Appl. No.: 279,730

[22] Filed: Jul. 25, 1994

Related U.S. Application Data

[63] Continuation-in-part of Ser. No. 236,814, May 2, 1994, Pat. No. 5,398,528, and Ser. No. 236,822, May 2, 1994, Pat. No. 5,469,596, and Ser. No. 236,830, May 2, 1994, Pat. No. 5,448,900.

[51] Int. Cl.[6] ..... D06F 37/28

[52] U.S. Cl. ..... 68/24; 68/58; 68/142

[58] Field of Search ..... 68/24, 58, 142; 366/233, 226, 229, 234, 236, 227, 228; 220/213, 252

[56] References Cited

U.S. PATENT DOCUMENTS

| | | | |
|---|---|---|---|
| 242,254 | 5/1881 | Bird | 220/252 |
| 947,701 | 1/1910 | Raymond | 220/213 |
| 1,300,710 | 4/1919 | Edwards | 220/252 |
| 1,682,093 | 8/1928 | Redman | 220/252 |
| 1,895,169 | 1/1933 | Mosel | 220/213 |
| 2,057,070 | 10/1936 | Strobridge | 220/213 |
| 2,120,167 | 6/1938 | Waream | 220/213 |
| 2,140,621 | 12/1938 | Gerlach | 220/213 |
| 2,579,761 | 12/1951 | Schmidtke | 68/139 |
| 2,864,526 | 12/1958 | Buss | 220/213 |
| 2,949,208 | 8/1960 | Widigen | 220/213 |
| 2,960,778 | 11/1960 | Cowlin | 34/130 |
| 3,280,603 | 10/1966 | Schwamm | 68/139 |
| 3,460,878 | 8/1969 | Peterson et al. | 312/297 |
| 3,553,782 | 1/1971 | Chery | 18/19 |
| 3,814,493 | 6/1974 | Radke | 312/297 |
| 4,807,684 | 2/1989 | Melton | 160/23.1 |
| 4,862,712 | 9/1989 | Huttemann | 68/17 |
| 4,921,033 | 5/1990 | Finch et al. | 160/133 |
| 4,947,937 | 8/1990 | Searer et al. | 160/133 |

*Primary Examiner*—Frankie L. Stinson
*Attorney, Agent, or Firm*—Stephen D. Krefman; Joel M. Van Winkle; Mark A. Davis

[57] ABSTRACT

An automatic washer having an enclosure surrounding an imperforate tub including an access opening and a perforate wash basket rotatably disposed within the tub about a horizontal axis wherein the tub access opening is provided with a flexible tub door for selectively closing the tub access opening. The flexible tub door is slidably supported by the tub for selectively closing the access opening wherein the tub door is positionable in a closed position and an open position. A spring is interconnected with the tub door for biasing the tub door toward an open position. A door catch is provided for engaging the tub door in a fully closed position against the biasing force of the spring and means are provided for selectively actuating the door catch such that the tub door may be selectively engaged in the closed position or released for movement to a fully open position. During the tub door closing operation, the rotatable wash basket is coupled to the tub door. In operation, therefore, selective movement of the catch releases the tub door to bias fully open. When the tub door is fully open, coupling between the tub door and basket is provided wherein rotation of the wash basket may drive the tub door to a closed position.

20 Claims, 7 Drawing Sheets

60
62
64
66
38b
36
38a
72
96
82
84
48
80
34
32
28
38b
64
36
38a
62

TUB DOOR SYSTEM FOR A TOP LOADING HORIZONTAL AXIS AUTOMATIC WASHER

CROSS REFERENCES TO RELATED PATENT APPLICATIONS

The present patent application is a continuation-in-part of each of the following applications: Ser. No. 08/236,814, filed May 2, 1994, entitled "Pulley System for Automatic Washer" now U.S. Pat. No. 5,398,528; Ser. No. 08/236,822, filed May 2, 1994, entitled "Basket Positioning System for a Top Loading Horizontal Axis Automatic Washer" now U.S. Pat. No. 5,469,596; and Ser. No. 08/236/830, filed May 2, 1994, entitled "System for Automatically Opening Basket Doors of a Top Loading Horizontal Axis Automatic Washer" now U.S. Pat. No. 5,448,900.

BACKGROUND OF THE INVENTION

The present invention relates to a top-loading horizontal axis automatic washer having a tub with an access opening and a rotatable basket disposed within the tub, and more particularly to a tub door system for selectively closing the tub access opening.

Typically, horizontal axis automatic washers employ either a front loading or a top loading configuration for receiving clothes items to be washed. U.S. Pat. No. 3,197,980 to Marple, assigned to the assignee of the present invention, shows a typical front loading horizontal washer wherein the horizontal wash basket is accessed through one of the vertical end walls of the horizontal basket and the front surface of the washer enclosure.

The preference of many consumers, however, particularly those in the U.S., is for top loading washers. Existing top loading horizontal axis washers include a rotatable wash basket disposed within an imperforate wash tub. A tub access opening is provided for accessing the wash basket, at least partially through the top surface of the washer. During the wash cycle and in particular during the spin extraction portion of the wash cycle, it is necessary to provide a splash guard to prevent wash liquid from undesirably exiting from the wash tub through the access opening. Typically, two different solutions have been utilized to manage this splash out problem.

In one solution, a boot is provided for sealably connecting the wash tub with the exterior cabinet structure. An exterior cabinet lid is then provided which sealably closes the tub access opening. This solution is undesirable, however, due in part to the relatively high cost and complexity of the boot design.

In another solution to the splash out problem, a manually openable hinged tub door is provided for sealably closing the tub access opening. Use of a hinged tub door, however, is also undesirable. A hinged tub door generally requires an additional motion by the user to open the door such that in a typical top loading horizontal washer, the user must open a cabinet lid, the hinged tub door and hinged wash basket doors to access the interior of the wash basket. This plurality of door openings is considered undesirable. Further, even if a hinged tub door were to be opened automatically, its very presence is considered undesirable because of the increased difficulty in loading and unloading a washer when a hinged tub door extends from the tub opening. It would be desirable, therefore, to configure a tub door to open and close automatically in a fashion which is substantially invisible to the user.

Some prior art attempts have been made to provide an automatically openable tub door. U.S. Pat. No. 3,280,603 discloses an automatic washer having a rotatable basket disposed within a tub wherein both the basket and the tub are provided with sliding doors. For opening the tub door, a solenoid driven connection or the like between the tub door and the rotating drum is effected wherein the rotation of the drum opens the tub door. To close the tub door, a similar coupling is made and the above-described motional action occurs in reverse order. In this fashion, a system for automatically opening the sliding tub door is provided.

The above described basket door opening system, however, contains many disadvantages. Chief among them is the relatively high cost and high degree of complexity. Also, due to the required motor operations, there will be an undesirable delay during the tub door opening procedure. Further, this type of system requires extensive pneumatic or electrical systems.

It would be an improvement in the art, therefore, if a low cost and simple tub door system were provided for preventing wash liquid splash out through the tub access opening. It would be a further improvement if the tub door system was substantially invisible to the user. Further, it would be desirable to have a tub door system for a top loading horizontal washer wherein the tub door serves to selectively close a tub access opening and further wherein the tub door opening and closing is performed automatically.

SUMMARY OF THE INVENTION

One object of the invention is to provide a tub door system for a top loading washer which is substantially invisible to the user.

Another object is to provide a relatively simple and low cost tub door system which automatically opens when access to the interior of a wash basket is desired.

Another object is to provide a top loading horizontal washer having a tub door which is automatically closed when closure of a tub access opening is desired.

Still another object is to provide a slidable tub door which is biased toward an open position and includes a system for automatically closing the tub door and a catch system for selectively engaging the tub door in a closed position.

According to the present invention, the foregoing and other objects are attained by an automatic washer having an enclosure including an opening provided with a lid hingedly connected to the enclosure for selectively covering the enclosure opening. The washer further includes an imperforate tub including an access opening and a perforate wash basket rotatably disposed within the tub about a horizontal axis. The wash basket includes an opening, provided with hinged doors, for accessing the interior of the basket. A flexible tub door is slidably supported by the tub for selectively closing the access opening wherein the tub door is positionable in a closed position and an open position. A spring is interconnected with the tub door for biasing the tub door toward an open position. A door catch is provided for engaging the tub door in a fully closed position against the biasing force of the spring and means are provided for selectively actuating the door catch such that the tub door may be selectively engaged in the closed position or released for movement to a fully open position.

During movement of the tub door from a fully closed position to a fully open position, a rib extending inwardly from the wash tub engages the tub door such that the rear edge of the tub door is deflected toward the wash basket.

When the rear edge is deflected toward the wash basket by the rib, a tub door hook extending from the wash basket may engage a drive tab extending from the rear edge of the tub door wherein during engagement between the drive tab and the tub door hook, rotation of the wash basket drives the tub door to a closed position. In operation, therefore, selective movement of the catch releases the tub door to bias fully open. When the tub door is fully open, coupling between the tub door and basket is provided wherein rotation of the wash basket may drive the tub door to a closed position.

DESCRIPTION OF PREFERRED EMBODIMENT

Figure 1:
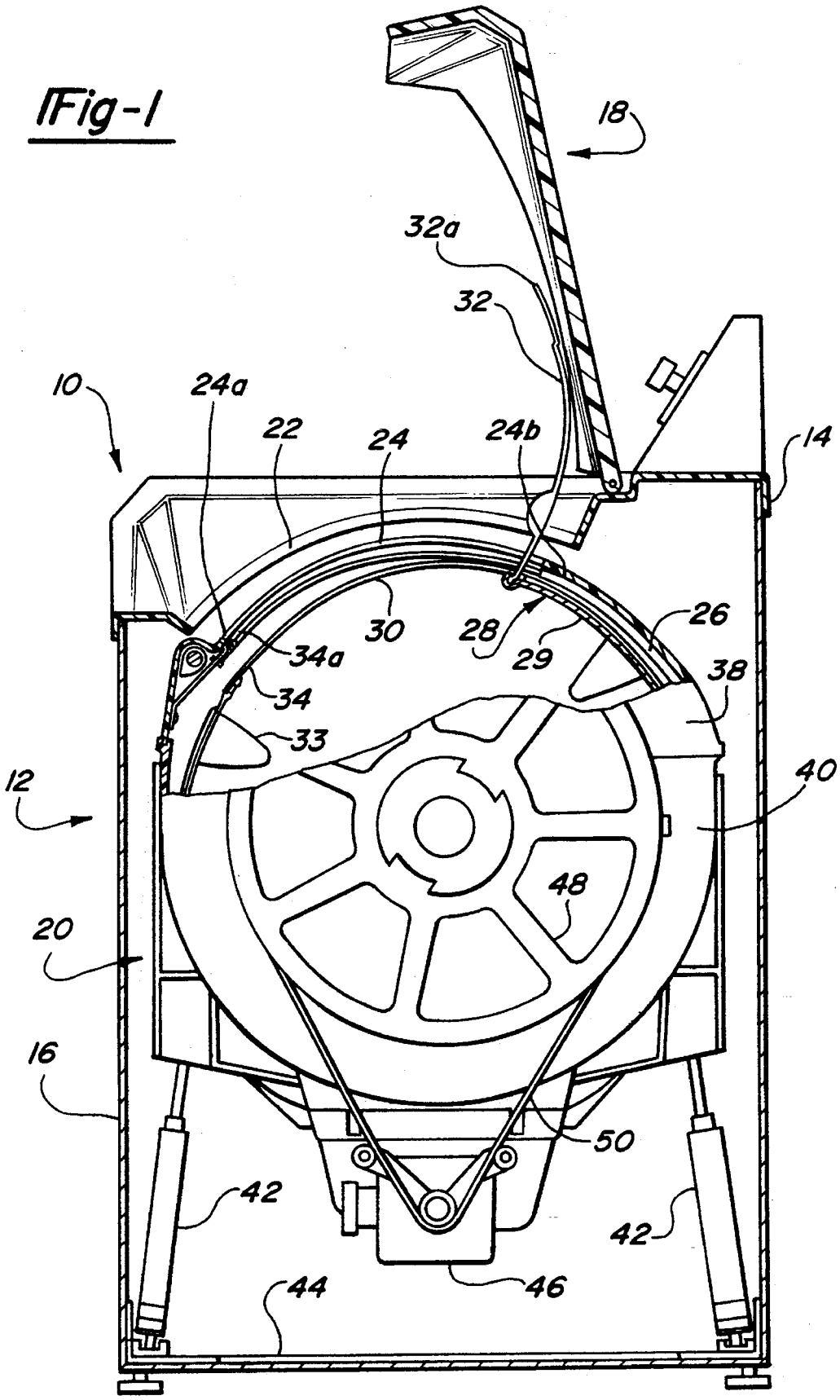
FIG. 1 is a partially cut away side elevational view of the automatic washer embodying the present invention having the lid, basket door flaps and tub door shown in the open position.

In FIG. 1 there is illustrated a top-loading drum-type automatic washer 10 embodying the principles of the present invention. The washer 10 has an enclosure 12 which includes a top member 14, an outer cabinet 16 and an openable lid 18, shown in an open position, which encloses an imperforate wash tub 20. The top member 14 includes an opening 22 extending partially along the top surface and the front surface of the enclosure for accessing the interior of the enclosure 12. The wash tub 20 has an upwardly orientated rectangular access opening 24 aligned with the opening 22. The access opening 24 includes a front edge **24*a* and a rear edge 24*b*. A slidable tub door 26, shown in the open position, is provided for selectively closing the tub access opening 24 and includes a rear edge 26*a* and a front edge 26*b***.

Disposed within the wash tub 20 is a rotatable, perforate wash basket 28 comprising a stainless steel cylindrical wrapper 29 and end walls 31. The wrapper 29 is provided with a rectangular basket opening 30 having an openable first door flap 32 and an openable second door flap 34 hingedly disposed on opposite edges of the opening 30. Each door flap includes a free edge portion **32*a* and 34*a*, respectively. The door flaps 32 and 34, shown in an open position, may be aligned with the tub opening 24 for allowing access into the wash basket 28 such that clothes may be loaded and unloaded from the wash basket 28. A plurality of baffles 33, attached to the inner surface of the basket 28 and extending inwardly, may be provided for enhancing the tumbling action of the clothes items within the basket 28 during a wash cycle. In the preferred embodiment, the end walls 31 of the wash basket 28 comprise balancing disks 36, shown in FIG. 2**, described in detail in pending U.S. patent application Ser. No. 07/997,435, Farrington et al., the specification of which is herein incorporated by reference.

The wash tub 20 preferably comprises a two piece construction including an upper tub member 38 and a lower tub member 40. The upper tub 38 includes side wall portions **38*a* and a peripheral wall 38*b*. The tub 20 is supported within the enclosure 12 by struts 42 extending from the lower tub member 40 to a frame 44. A motor 46 is supported from the lower tub member 40 and is drivably connected to a pulley 48 by a belt 50. The pulley 48 is drivably interconnected with the basket 28 such that the motor 46 may rotate the basket 28 within the tub 20**.

Figure 2:
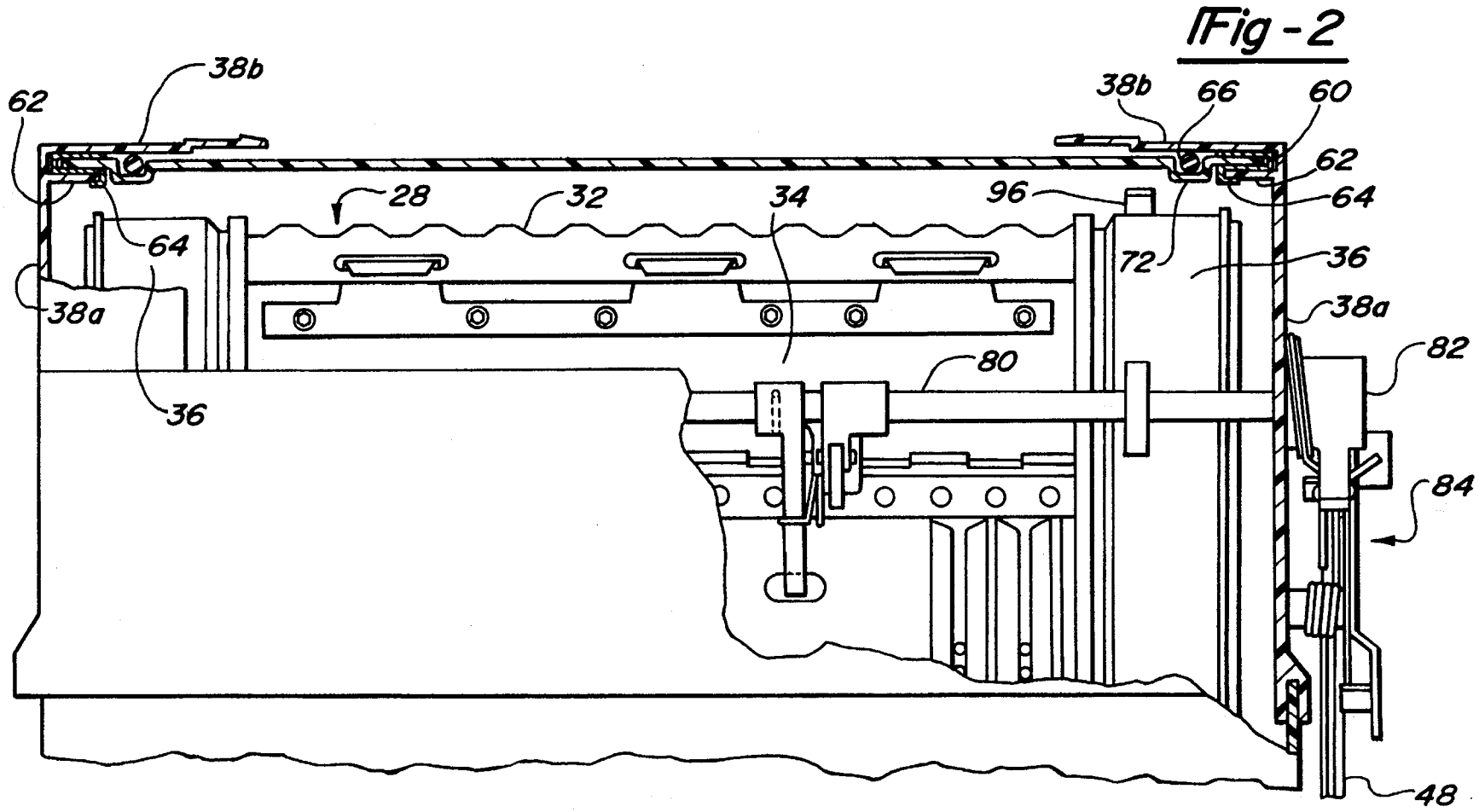
FIG. 2 is a partially cut away front elevational view of the wash tub and wash basket of the present invention.
Figure 3:
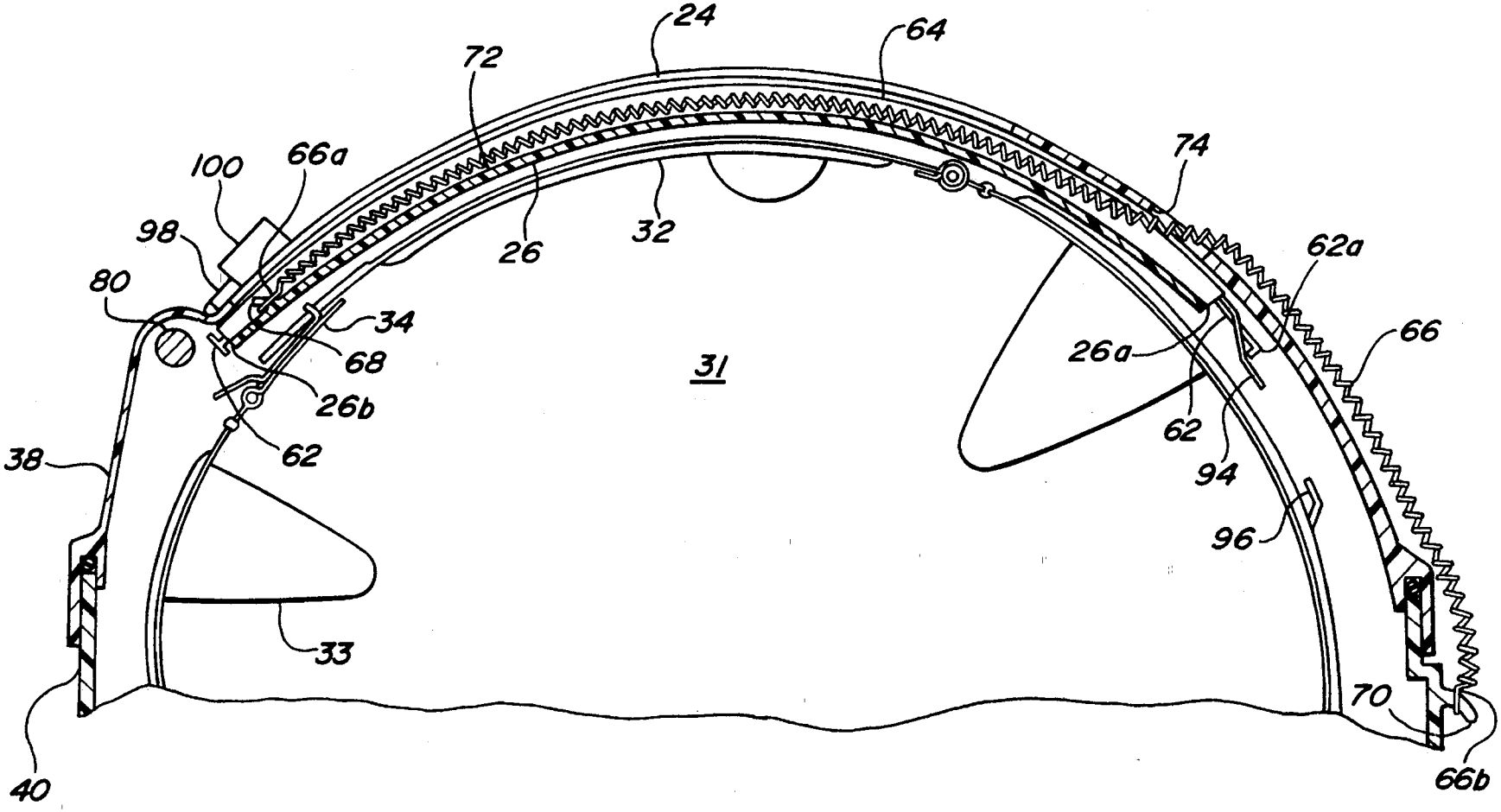
FIG. 3 is a sectional view of the tub door, wash basket and tub of the present invention with the tub door in its closed position.

Turning now to FIGS. 2 and 3, the slidable tub door 26, oriented in the closed position, is shown in greater detail. The tub door 26 is slideably positioned within tracks 60 formed into the upper tub member 38. The tracks 60 are defined by ribs 62, inwardly extending from the side walls **38*a* of the upper tub member 38, and the peripheral wall 38*b* of the upper tub member 38. Low friction inserts 64 are positioned within the tracks 60 for enhancing the slidability of the tub door 26 within the tracks 60. When the tub door is in a closed position, the door tracks 60 and the overlap of the tub door 26 and the upper tub 38 at each of the tub door ends combine to form a labyrinth seal along the outer periphery of the tub door 26 such that wash liquid is prevented from splashing out of the wash tub 20 through the access opening 24** during the wash cycle.

The tub door 26 is further provided with an extension spring 66 for biasing the door 26 toward an open position. The spring 66 connects at a first end **66*a* to a hook portion 68 extending from the tub door 26 and at a second end 66*b* to the lower tub member 40 by way of a hook portion 70. The second end 66*b* may alternatively be connected to the upper tub member 38, depending on the design of the spring 66. The extension spring 66 rides partially within a channel 72 formed into the tub door 26 such that the extension spring 66 is positioned between the tub door 26 and the peripheral wall 38*b* of the upper tub 38. At a predetermined distance beyond the rear edge 24*b* of the access opening 24, a spring opening 74 is provided in the upper tub 38 for allowing the spring 66 to exit from the interior of the upper tub 38 and ride along the exterior surface of the peripheral wall 38*b* and connect with the hook portion 70**.

Figure 4:
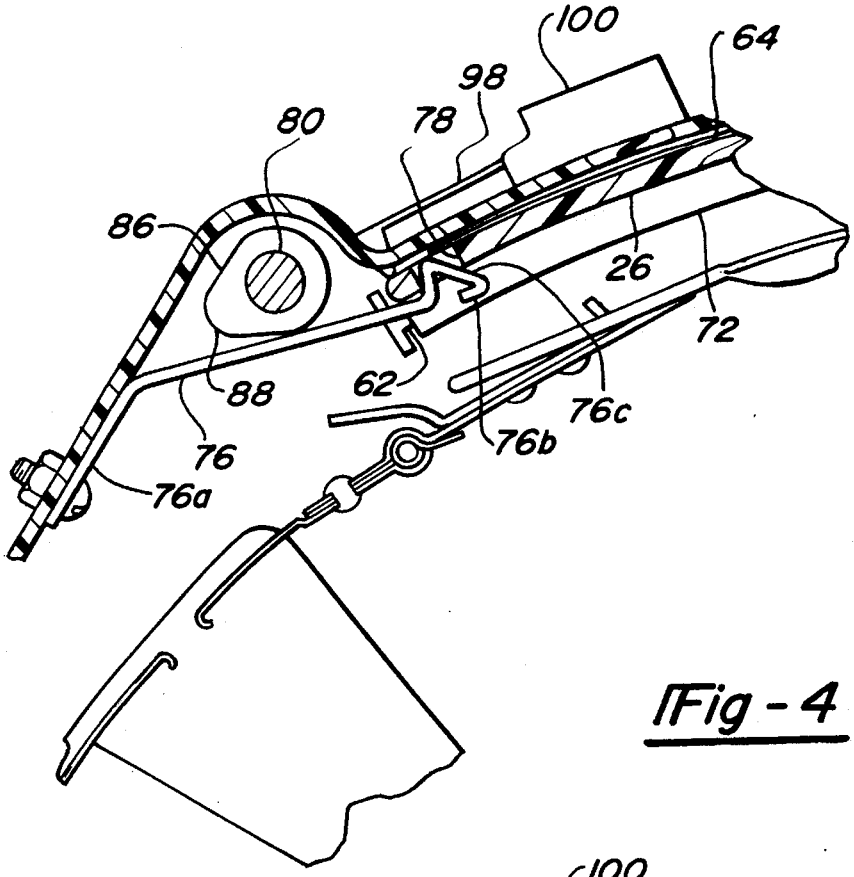
FIG. 4 is an enlarged sectional view showing in part the catch and tub door of the present invention, wherein the tub door is in a fully closed position.
Figure 5:
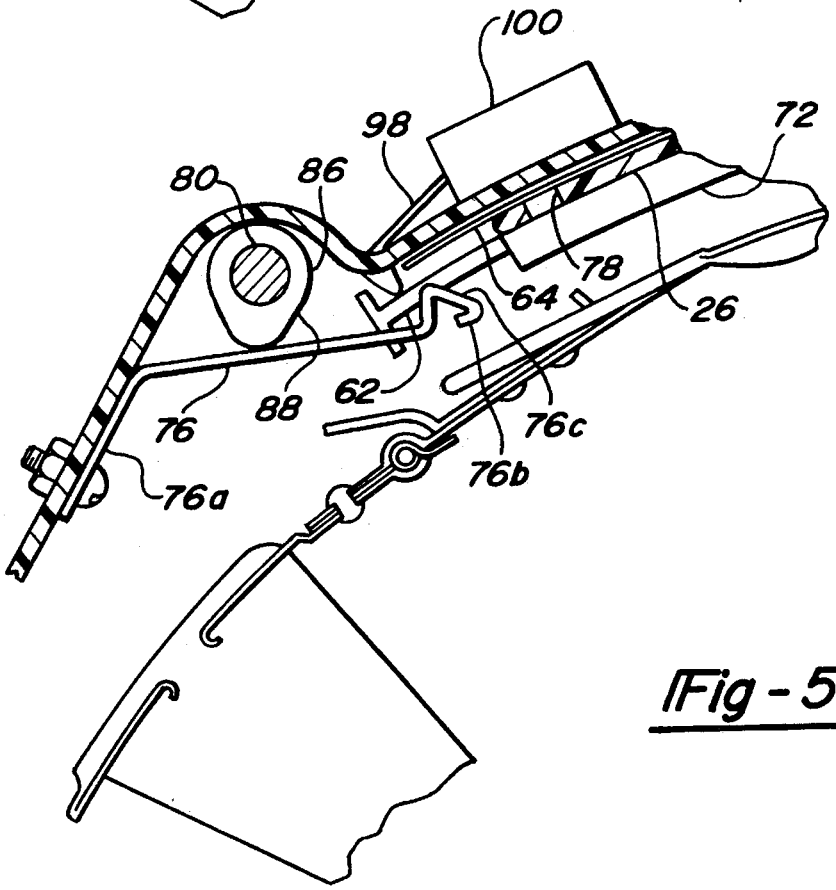
FIG. 5 is an enlarged sectional view showing in part the catch and tub door of the present invention, wherein the tub door is in a partially closed position.

As described above, the tub door 26 is biased toward an open position by the spring 66. The tub door 26, however, may be engaged in a closed position. Turning now to FIGS. 4 and 5, a catch system for securing the tub door 26 in a closed position is shown, including a catch 76. The catch 76 may preferably be formed from resilient, spring steel and includes a first end **76*a* interconnected with the upper member 38 and a second hooked end 76*b* for engaging a catch opening 78 provided in the tub door 26 such that the tub door is held in a closed position. It can be understood by one skilled in the art that movement or actuation of the catch 76 is required for selectively engaging and disengaging the catch 76 with tub door 26. To this end, a cam 86 having a cam portion 88 is provided, supported on a rotatable control shaft 80**.

The control shaft 80 is shown, in FIG. 2, supported within the tub 20 and disposed adjacent the rotatable basket 28. The control shaft 80 is rotatably supported at opposite ends by the upper tub member 38 and includes at least one end extending through the upper tub member 38 wherein a rotary positioning member or rotary positioning hub 82 is secured to the control shaft 80 outside the upper tub member 38. A latching mechanism 84 is provided adjacent the hub 82 for latching the hub 82 in a predetermined position. The structure and operation for selectively rotating the control shaft 80 through a plurality of predetermined angular positions is disclosed in the prior U.S. patent applications referred to in the Cross Reference portion of this application, the contents of which are hereby incorporated by reference. This reference further discloses a system for automatic positioning the basket 28 within the tub 20 for aligning the basket doors 32 and 34 with the tub access opening 24 and a system for automatically opening the basket doors 32 and 34 when access to the interior of the basket is desired.

In FIG. 4, it can be seen that the control shaft 80 is orientated in a first angular position, herein termed angular position "A", wherein the cam portion 88 is positioned away from the catch 76 such that the cam 86 is not engaging the catch 76. The catch 76 is configured such that the second end **76*b* is biased counter-clockwise, toward the peripheral wall 38*b* of the upper tub member 38. In this configuration, when the tub door 26 is oriented in a closed position, the hooked end 76*b* of the catch 76 engages the catch opening 78 of the tub door 26 such that the tub door 26** is held in a closed position.

In FIG. 5, the control shaft 60 is selectively oriented in a second angular position, herein termed angular position "B", wherein the cam portion 88 is positioned toward the catch 76 such that the cam portion 88 engages the catch 76 and deflects the hooked end **76*b* of the catch 76 clockwise, away from the front edge 24*a* of the access opening 24. In this position, the tub door 26 is released from the hooked end 76*b* of the catch 76 and under the urgings of the spring 66** is biased toward an open position.

Figure 6:
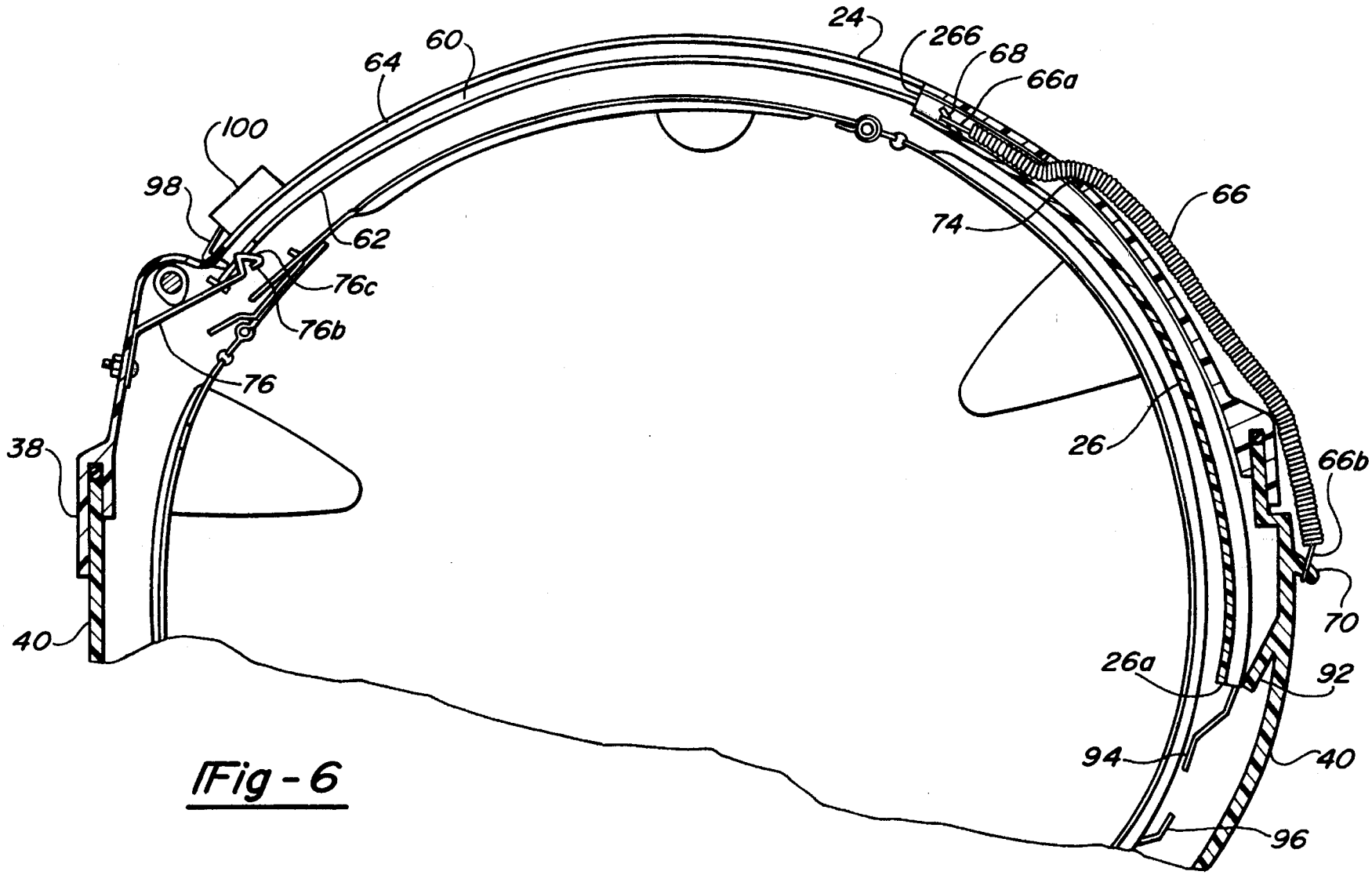
FIG. 6 is a sectional view of the tub door, wash basket and tub of the present invention with the tub door in its open position.

Turning now to FIG. 6, it can be seen that when biased toward an open position, the tub door 26 moves within the tracks 60 clockwise relative to the tub 20. As the tub door 26 moves within the tracks 60, from a closed position to an open position, the rear edge **26*a* of the tub door 26 engages a rib 92 extending inwardly from the lower tub member 40. This rib is configured to act as a ramp or guide for directing the rear edge 26*a* of the tub door 26 toward the outer periphery of the wash basket 28. A drive tab 94, extending from the rear edge 26*a* of the tub door 26, is positioned adjacent the outer periphery of the wash basket 28** when the tub door is in a fully open position.

The rib 92 is positioned on the lower tub member 40 in such a location that engagement between the rear edge **26*a* of the tub door 26 and the rib 92 occurs as the tub door 26 approaches a completely open position. In this manner, the rear edge 26*a* contacts the rib 92 before the tub door comes to a completely open position. This contact serves as a braking mechanism such that the movement of the tub door 26 from a closed position to an open position is gradually deaccelerated, thereby preventing undesirable slamming or jarring of the tub door 26** into a fully open position.

The deflection of the rear edge of the tub door 26 by the rib 92 is facilitated by limiting the length of the ribs 62, thereby limiting the length of the tracks 60. The ribs 62 terminate at an end point **62*a* (FIG. 3), well short of the final position of the rear edge 26*a*** when the tub door is completely opened.

Closing the tub door 26 is effected by coupling the tub door 26 to the rotatable basket 28 and rotating the basket 28. This may be accomplished by providing a tub door hook 96 extending outwardly from the outer periphery of the wash basket 28. In the preferred embodiment, the tub door hook 96 may be formed as an integral part of one of the balancing rings 36. The tub door hook 96 is configured for engaging the drive tab 94, which is disposed adjacent the outer periphery of the wash basket 28, when the basket 28 is driven in a counter-clockwise direction and the tub door 26 is in a fully open position. In this fashion, when the tub door hook 96 has engaged the drive tab 94, counter-clockwise rotation of the wash basket 28 drives the tub door 26 counter-clockwise within the slots 60 toward a closed position.

Figure 7:
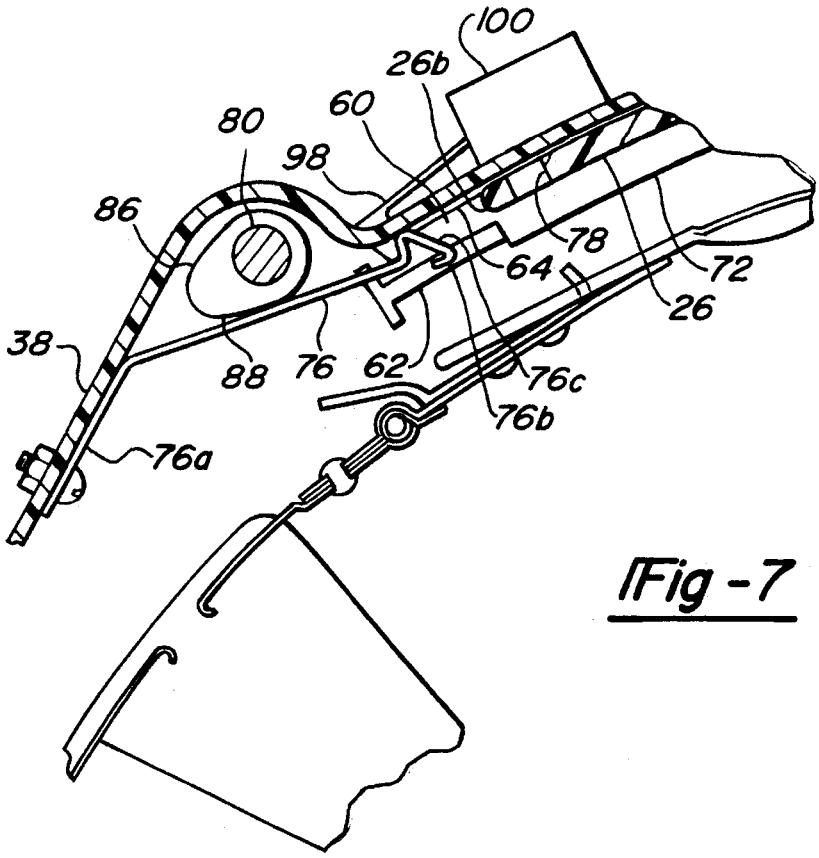
FIG. 7 is an enlarged sectional view showing in part the catch and tub door of the present invention, wherein the tub door is in a partially closed position and the catch is oriented to receive the tub door.

Turning now to FIG. 7, as the tub door nears a fully closed position, the front edge **26*b* approaches the hooked end 76*b* of the catch 76 and a lever arm 98 of a switch 100. The lever arm 98 extends through the upper tub 38 such that as the tub door 26 moves to a completely closed position, the lever arm 98 is deflected by the tub door 26 such that the switch 100 may sense when the tub door 26 is fully closed. During the tub door closing operation, the control shaft is oriented in angular position "A" such that the catch 76 is positioned for engaging the tub door 26. As the tub door moves to a completely closed position, the front edge 26*b* of the tub door 26 engages a ramped surface 76*c* of the hooked end 76*b* of the catch 76 for deflecting the catch until the hooked end 76*b* aligns with the catch opening 78** wherein the tub door is securely engaged in a closed position.

In this manner, therefore, during the tub door closing operation, the wash basket 28 is driven in a counter-clockwise direction until the switch 100 sense a fully closed tub door position. Alternatively, a fully closed tub door condition may be determined by sensing a locked rotor condition for the motor 46, as can be understood by one skilled in the art. When complete closure of the tub door 26 is sensed, counter-clockwise rotation of the wash basket is stopped and clockwise rotation of the wash basket 28 is initiated. Upon initiation of this clockwise rotation, the tub door hook 96 releases the drive tab 94 whereupon the drive tab 94 springs back adjacent the inner surface of the upper tub member 38 such that no engagement occurs between the tub door hook 96 and the drive tab 94 upon subsequent rotation of the tub door hook 96 past the drive tab 94.

Figure 8:
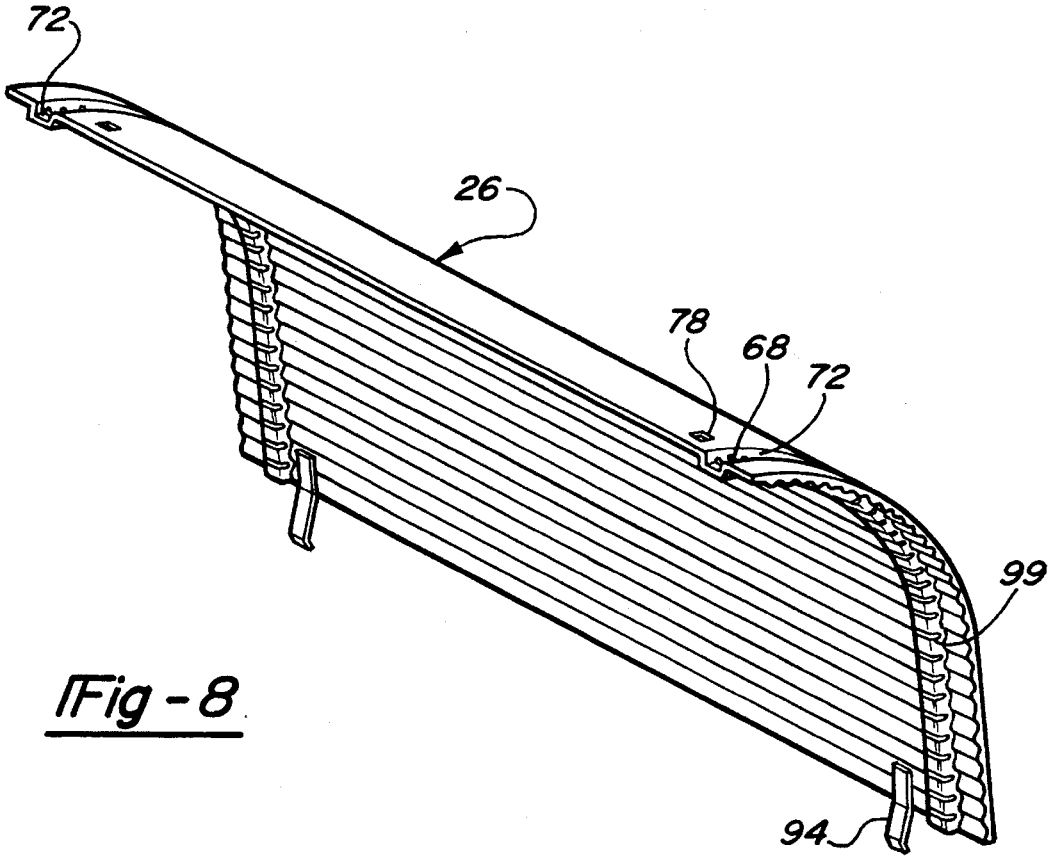
FIG. 8 is a top, front and side perspective view of the tub door of FIG. 1.

In FIG. 8, details of the tub door 26 are illustrated. In this Figure, the channel 72 is shown on both sides of the tub door 26. Although as contemplated by the inventor, only one spring would be provided for biasing the tub door open, it is possible to utilize two springs, one on each side of the tub door 26. The catch opening 78 is shown adjacent the front edge **26*b* of the tub door 26. Although only one catch opening 78 is shown, two catch openings and two catch systems may be provided for securing the tub door 26** on both sides.

The tub door is configured to include a corrugated or wave-like structure such that the tub door may readily flex. Additionally, slots 99 may be provided along the outer edges of the channels 72 at predetermined spaced intervals such that the channels 78 may flex and thereby not stiffen the tub door 26.

In a wash cycle operation, therefore, when the washing machine 10 is washing clothes, the tub door 26 is engaged in a closed position, as can be readily understood by one of skill in the art. During the wash cycle, the control shaft 80 is selectively oriented in the angular position "A". When access to the interior of the wash basket is desired, such as at the end of the wash cycle or during the wash cycle for adding additional clothes items, the control shaft 80 is selectively moved to the angular position "B". This results in the release of the tub door 26 and its subsequent movement to a fully open position. The selective rotation of the control shaft 80 to angular position "B" may be accompanied by an automatic positioning of the wash basket 28 within the tub 20 for aligning the wash basket doors 32 and 54 with the access opening 24.

When the closure of the tub door is required, such as at the reinitiation of the wash cycle, the wash basket is driven in a counter-clockwise direction for engaging the tub door 25, as described above. Prior to the tub door closure operation, the control shaft 80 has been selectively returned to the angular position "A" such that the catch 76 is positioned to receive the tub door 26. When complete tub door closure is sensed, the counter-clockwise rotation of the wash basket 28 is stopped and clockwise rotation is initiated, releasing the drive tab 94 from the tub door hook 96, as described above.

Figure 9:
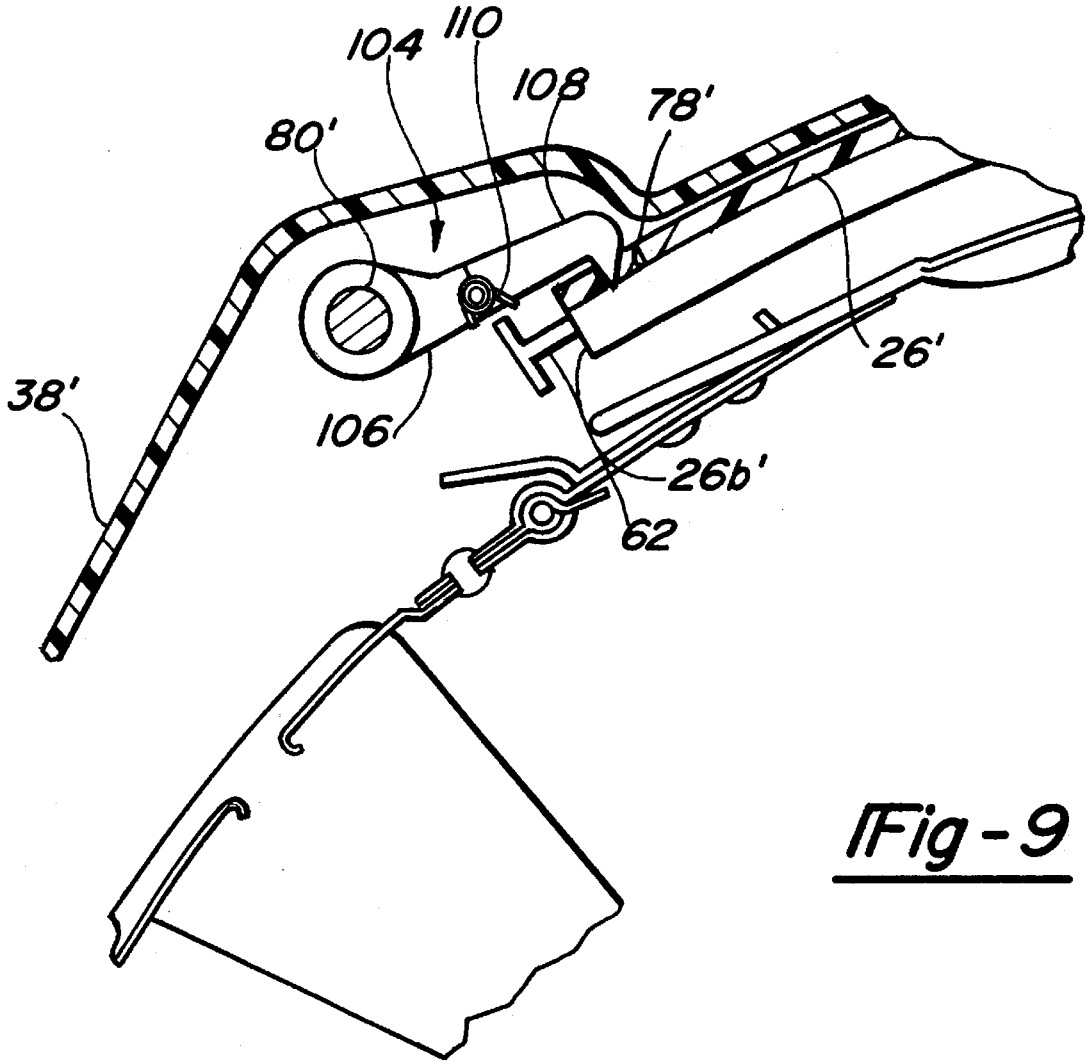
FIG. 9 is an enlarged sectional view showing in part an alternative embodiment of the catch and tub door of the present invention.

In FIG. 9 an alternative embodiment is shown wherein a tub door catch 104 is provided extending from a control shaft 80' for selectively engaging a tub door 26' in a closed position. The tub door catch 104 may include a drive arm member 106 which rigidly engages the control shaft 80 for rotation therewith, and a tub door hook 108 being hingedly mounted at the end of the drive arm 106. A spring 110 is provide for biasing the tub door hook 108 toward the basket 28 wherein the tub door hook 108 is positioned by the hinged connection and the spring 110 to extend straight from the drive arm 104 radially away from the center of the drive shaft 80. As can be understood by one skilled in the art, with this type of alternative configuration, the tub door hook 108 may selectively engage a catch opening 78' for selectively securing the tub door 26' in a closed position. Further, counter-clockwise rotation of the tub door catch 104 by the control shaft 80' releases the tub door hook 108 from the tub door 26' such that the tub door may be biased open.

Although the present invention has been described with reference to specific embodiments, those of skill in the art will recognize that changes may be made thereto without departing from the scope and spirit of the invention as set forth in the appended claims. For example, the tub door catch may be driven by an electromechanical means for selectively engaging the tub door in a closed position. Further, the drive tab 94 may be integrally formed with the tub door 26. Additionally, the tub door may be configured to be substantially rigid rather than flexible. Further, it can be understood by one skilled in the art that various types of biasing means may be provided for biasing the tub door open. For example, a constant force spring may be supplied for drawing or pushing the tub door open. Further a compression spring may be utilized for biasing the tub door open.

It should be understood, therefore, that we wish to embody within the scope of the patent warranted hereon all such modifications as reasonably and properly come within the scope of our contribution to the art.

We claim:

1. An automatic washer comprising:

an imperforate tub having an access opening for accessing the interior of said tub;

a perforate wash basket disposed within said tub and being rotatable about a horizontal axis;

a tub door having a from edge and a rear edge and being slidably supported for selectively closing said access opening, said tub door being positionable in a closed and an open position;

a spring interconnected with said tub door for biasing said tub door toward said open position;

a catch for selectively engaging said tub door in a closed position;

a rib extending inwardly from the wash tub toward the wash basket, said rib being positioned such that said rib deflects said rear edge of said tub door toward said wash basket when said tub door is biased to said open position; and a tub door hook extending from said wash basket for engaging said rear edge of said tub door when said rear edge is deflected toward said wash basket by said rib, wherein when said rear edge is deflected toward said wash basket by said rib, said tub door hook engages said rear edge of said tub door when said tub door hook is rotated past said read edge of said tub door such that rotation of said wash basket drives said tub door to a closed position.

2. The automatic washer according to claim 1 wherein said tub door is slidably supported by said tub.

3. The automatic washer according to claim 1 wherein said tub door is flexible.

4. The automatic washer according to claim 1, further comprising:

means for selectively closing said tub door such that said tub door moves from an open position to a closed position.

5. The automatic washer according to claim 1, further comprising:

a drive tab extending from said rear edge of said tub door, said drive tab being positioned adjacent the outer periphery of said wash basket when said tub door is deflected toward said wash basket, wherein said tub door hook may engage said drive tab for driving said tub door to a closed position.

6. The automatic washer according to claim 1 further wherein:

said tub door includes a catch opening; and said catch is interconnected with said tub and includes an end forming a hook, said catch is further biased toward a position wherein said hook of said catch engages said catch opening of said tub door.

7. The automatic washer according to claim 1 wherein said catch is interconnected with said tub, said automatic washer further comprising:

means for selectively actuating said door catch for selectively engaging said tub door in said closed position.

8. The automatic washer according to claim 1 wherein said catch is interconnected with said tub, said automatic washer further comprising:

a selectively rotatable control shaft supported by said tub, said control shaft engaging said door catch for selectively moving said door catch for selectively engaging said tub door.

9. The automatic washer according to claim 1, further comprising:

a selectively rotatable control shaft supported by said tub, and said catch extending from said control shaft for selective engagement with said tub door wherein rotation of said control shaft selectively moves said door catch for selectively engaging said tub door in a closed position.

10. An automatic washer comprising:

an imperforate tub having an access opening for accessing the interior of said tub;

a perforate wash basket disposed within said tub and being rotatable about a horizontal axis;

a tub door having a front edge and a rear edge and being slidably supported for selectively closing said access opening, said tub door being positionable in a closed position and open position;

a spring interconnected with said tub door for biasing said tub door toward said open position;

means for selectively engaging said tub door in a closed position;

means for deflecting said rear edge of said tub door toward said wash basket when said tub door is biased to said open position; and a tub door hook extending from said wash basket for engaging said rear edge of said tub door when said rear edge is deflected toward said wash basket by said rib, wherein said rear edge is deflected toward said wash basket, said tub door hook engages said rear edge of said tub door when said tub door hook is rotated past said read edge of said tub door such that rotation of said wash basket drives said tub door to a closed position.

11. The automatic washer according to claim 10, further comprising:

means for selectively coupling said tub door with said wash basket for moving said tub door from an open position to a closed position.

12. The automatic washer according to claim 10, further comprising:

a drive tab extending from said rear edge of said tub door, said drive tab being positioned adjacent the outer periphery of said wash basket when said tub door is deflected toward said wash basket, wherein said tub door hook may engage said drive tab for driving said tub door to a closed position.

13. The automatic washer according to claim 10 wherein said catch is interconnected with said tub, said automatic washer further comprising:

means for selectively actuating said door catch for selectively engaging said tub door in said closed position.

14. The automatic washer according to claim 10 wherein said catch is interconnected with said tub, said automatic washer further comprising:

a selectively rotatable control shaft supported by said tub, said control shaft engaging said door catch for selectively moving said door catch for selectively engaging said tub door.

15. The automatic washer according to claim 10, further comprising:

a selectively rotatable control shaft supported by said tub, and said catch extending from said control shaft for selective engagement with said tub door wherein rotation of said control shaft selectively moves said door catch for selectively engaging said tub door in a closed position.

16. An automatic washer comprising:

an imperforate tub having an access opening for accessing the interior of said tub;

a perforate wash basket disposed within said tub and being rotatable about a horizontal access a tub door having a front edge and a rear edge and being slidably supported for selectively closing said access opening, said tub door being positionable in a closed position and an open position;

a spring interconnected with said tub door for biasing said tub door toward said open position;

a catch for selectively engaging said tub door in a closed position;

a coupler having a first member on the wash tub and a second member on the wash basket wherein the first member and second member engage to couple the movement of the tub door with the rotation of the wash basket when the wash basket is rotated in a first direction, but the first and second members do not engage and the movement of the door and the wash basket are not coupled when the wash basket is rotated in a second direction opposite the first direction.

17. An automatic washer according to claim 16, wherein the first member comprises a portion of the wash tub and the second member comprises a portion of the wash basket.

18. An automatic washer according to claim 17, wherein the portion of the wash tub includes a rib extending inwardly from the tub to deflect the rear edge of the tub door toward the wash basket when the tub door is biased to the open position.

19. An automatic washer according to claim 18, wherein the deflector is a rib extending inwardly from the wash tub toward the wash basket.

20. An automatic washer according to claim 17, wherein the portion of the wash basket comprises a hook extending from the wash basket for engaging the rear edge of the tub door when the tub door is in the open position.

* * * * *